US011737572B1

(12) United States Patent
Zhang

(10) Patent No.: US 11,737,572 B1
(45) Date of Patent: Aug. 29, 2023

(54) DETACHABLE ASSEMBLED LOUNGE FURNITURE

(71) Applicant: Nanjing Huandatong Electronic Technology Co., Ltd, Nanjing (CN)

(72) Inventor: Bingbing Zhang, Shouguang (CN)

(73) Assignee: Nanjing Huandatong Electronic Technology Co., Ltd, Nanjing (CN)

( * ) Notice: Subject to any disclaimer, the term of this patent is extended or adjusted under 35 U.S.C. 154(b) by 0 days.

(21) Appl. No.: 18/190,709

(22) Filed: Mar. 27, 2023

(30) Foreign Application Priority Data

Feb. 27, 2023 (CN) ..... 202320326024.0

(51) Int. Cl.
*A47C 17/04* (2006.01)
*A47C 4/03* (2006.01)

(52) U.S. Cl.
CPC ..... *A47C 17/04* (2013.01); *A47C 4/03* (2013.01)

(58) Field of Classification Search
CPC ..... A47C 17/04; A47C 17/34; A47C 17/37; A47C 4/03; A47C 4/02; A47C 4/021
USPC ..... 297/233
See application file for complete search history.

(56) References Cited

U.S. PATENT DOCUMENTS 3,658,382 A * 4/1972 Anderson ..... F16B 12/00 403/219
4,305,616 A * 12/1981 Martinez ..... A47C 4/028 297/411.27
2021/0196049 A1* 7/2021 McCreary ..... A47C 17/04
2022/0312960 A1* 10/2022 Junge ..... A47B 47/0041
2022/0408929 A1* 12/2022 Gansow ..... A47C 13/005

FOREIGN PATENT DOCUMENTS

CN 210354017 U 4/2020
CN 211117006 U 7/2020
CN 211431741 U 9/2020
JP 3570321 * 9/2004

* cited by examiner

*Primary Examiner* — Mark R Wendell
(74) *Attorney, Agent, or Firm* — Nitin Kaushik

(57) ABSTRACT

The invention relates to a detachable assembled lounge furniture, comprising a plurality of components: a component A, a component B, a component C, a component D, a component E, a component F, a component G, a component H, a component I, a component J, a component K, a component L, and a component M, which are formed into various combinations to constitute various lounge furniture. Advantages. 1. A detachable assembled lounge furniture is provided, which is designed to be divided into various components. The user can combine, add and remove the components according to his/her own needs to form a variety of furniture with different structures, models and sizes, so as to satisfy the user's needs to the maximum extent. 2. When making a move, the furniture can be disassembled into single components to move, so as to reduce the difficulty of moving up and down stairs.

4 Claims, 21 Drawing Sheets

DETACHABLE ASSEMBLED LOUNGE FURNITURE

CROSS-REFERENCE TO RELATED APPLICATIONS

The application claims priority to Chinese patent application No. 2023203260240, filed on Feb. 27, 2023, the entire contents of which are incorporated herein by reference.

TECHNICAL FIELD

The invention relates to the technical field of furniture, and in particular to a detachable assembled lounge furniture.

BACKGROUND

In the current market lounge furniture, sofa, tea table, etc. are basically non-detachable fixed structures. After the user purchases them, the style and size can no longer be changed. Each user's indoor structure is quite different. It is very difficult to find the furniture that conforms to various indoor spaces in the market, which makes the lounge furniture difficult to fully meet the user's requirements. In addition, it is difficult to move them, especially when making a move, as the sofa, the wardrobe, etc. are the most difficult furniture to move up and down stairs. The invention provides a detachable assembled lounge furniture, which is designed to divide the lounge furniture into various components. The user can combine, add and remove the components according to his/her own needs to form a variety of furniture with different structures, models and sizes, so as to satisfy the user's needs to the maximum extent.In addition, when making a move, the furniture can be disassembled into single components to move, so as to reduce the difficulty of moving up and down stairs.

SUMMARY

The main object of the invention is to provide a detachable assembled lounge furniture so as to effectively solve the problems raised in the background art.

In order to achieve the above-mentioned object, the invention adopts the following technical solutions. A detachable modular lounge furniture comprises a plurality of components: a component A, a component B, a component C, a component D, a component E, a component F, a component G, a component H, a component I, a component J, a component K, a component L, and a component M, which are formed into various combinations to constitute various lounge furniture;

the structure of each component is as follows:

Component A, wherein four L-shaped connecting plates with equal side lengths are made of metal strips; an upper threaded hole and a lower threaded hole are provided on a corner folding line of the L-shaped connecting plate; rectangular metal pipes with equal lengths are welded outside two sides of the L-shaped connecting plate respectively; four L-shaped connecting plates and four rectangular metal pipes constitute a square frame with an unfilled corner, the metal strips are welded on the frame at intervals in the middle of the frame to form a table top; the metal strips are provided below the table top as reinforcing ribs;

Component B, wherein four L-shaped connecting plates with equal side lengths are made of metal plate strips; an upper threaded hole and a lower threaded hole are provided on a corner folding line of the L-shaped connecting plate; rectangular metal pipes with unequal lengths are welded outside two sides of the L-shaped connecting plate; four L-shaped connecting plates and four rectangular metal pipes with unequal lengths constitute a rectangular frame with an unfilled corner; the metal plate strips are welded on the frame at intervals in the middle of the frame to constitute a table top; the metal plate strips are provided below the table top as reinforcing ribs; a wooden table top is provided on one side of the table top of the rectangular frame;

Component C, wherein four L-shaped connecting plates with equal side lengths are made of metal strips; an upper threaded hole and a lower threaded hole are provided on a corner folding line of the L-shaped connecting plate; rectangular metal pipes with unequal lengths are welded outside two sides of the L-shaped connecting plate; four L-shaped connecting plates and four rectangular metal pipes with unequal lengths form a rectangular frame with an unfilled corner; the metal plate strips are welded on the frame at intervals in the middle of the frame to form a table top; metal plate strips are provided below the table top as reinforcing ribs;

Component D, a moon-shaped back rest made of a metal tube, wherein an insert block with an n-shaped groove is provided below two vertical Component E, a support leg made of a metal square tube, wherein an upper through hole and a lower through hole are provided on a flanging line of the square tube at the upper end of the support leg; the top surface of the support leg is plugged with a steel plate; a rubber pad is provided below the support leg;

Component F, a square table top with spaced wooden slats;

Component G, a square sofa cushion;

Component H, a rectangular sofa cushion, the length of which is twice that of the square sofa cushion, and the width of which is the same as that of the square sofa cushion;

Component I, a sofa back, wherein a pouch is provided on the back and may be sheathed on the sofa back rest of the component D;

Component J, a short back of the sofa, wherein a pouch is provided on the back and may be sheathed on the sofa back rest of the component D;

Component K, an n-shaped clip made of plastic, wherein both sides are in an inverted cone shape; a hook is provided at a lower part of the n-shaped clip for clamping adjacent component frame rims together;

Component L, a bolt; and

Component M, a spacer.

Preferably, the rectangular frame of the component C has a length twice that of the component A.

Preferably, the components A, B, C and F have the same width.

Preferably, after the component E is respectively connected with the components A, B and C by means of the components L and M, the top surface of the component E is at the same height as the table tops of the frames of the components A, B and C.

The beneficial effects of the invention are as follows, 1. The invention provides a detachable assembled lounge furniture, which is designed to divide the lounge furniture into various components. The user can combine, add and remove the components according to his/her own needs to form a variety of furniture with different structures, models and sizes, so as to satisfy the user's needs to the maximum extent, 2. When making a move, the furniture can be disassembled into single components to move, so as to reduce the difficulty of moving up and down stairs.

BRIEF DESCRIPTION OF DRAWINGS

In FIGS. 1-21, 1, appearance of Embodiment 1; 1-1, frame of Embodiment 1; 2, appearance of Embodiment 2; 2-1, frame of Embodiment 2; 3, appearance of Embodiment 3; 3-1, frame of Embodiment 3; 4, appearance of Embodiment 4; 4-1, frame of Embodiment 4; 5, appearance of Embodiment 5; 5-1, frame of Embodiment 5; 6, threaded hole; 7 small wooden table; 8 insert block; 9, through hole; 10 rubber pad; 11 pouch.

DETAILED DESCRIPTION OF THE EMBODIMENTS

The technical solutions in the embodiments of the invention will be clearly and completely described below in connection with the embodiments of the invention. It is obvious that the described embodiments are only a part of the embodiments of the invention, rather than all the embodiments. Based on the embodiments of the invention, all the other embodiments obtained by a person of ordinary skill in the art without involving any inventive effort fall within the scope of protection of the invention.

Embodiment 1

Figure 1:
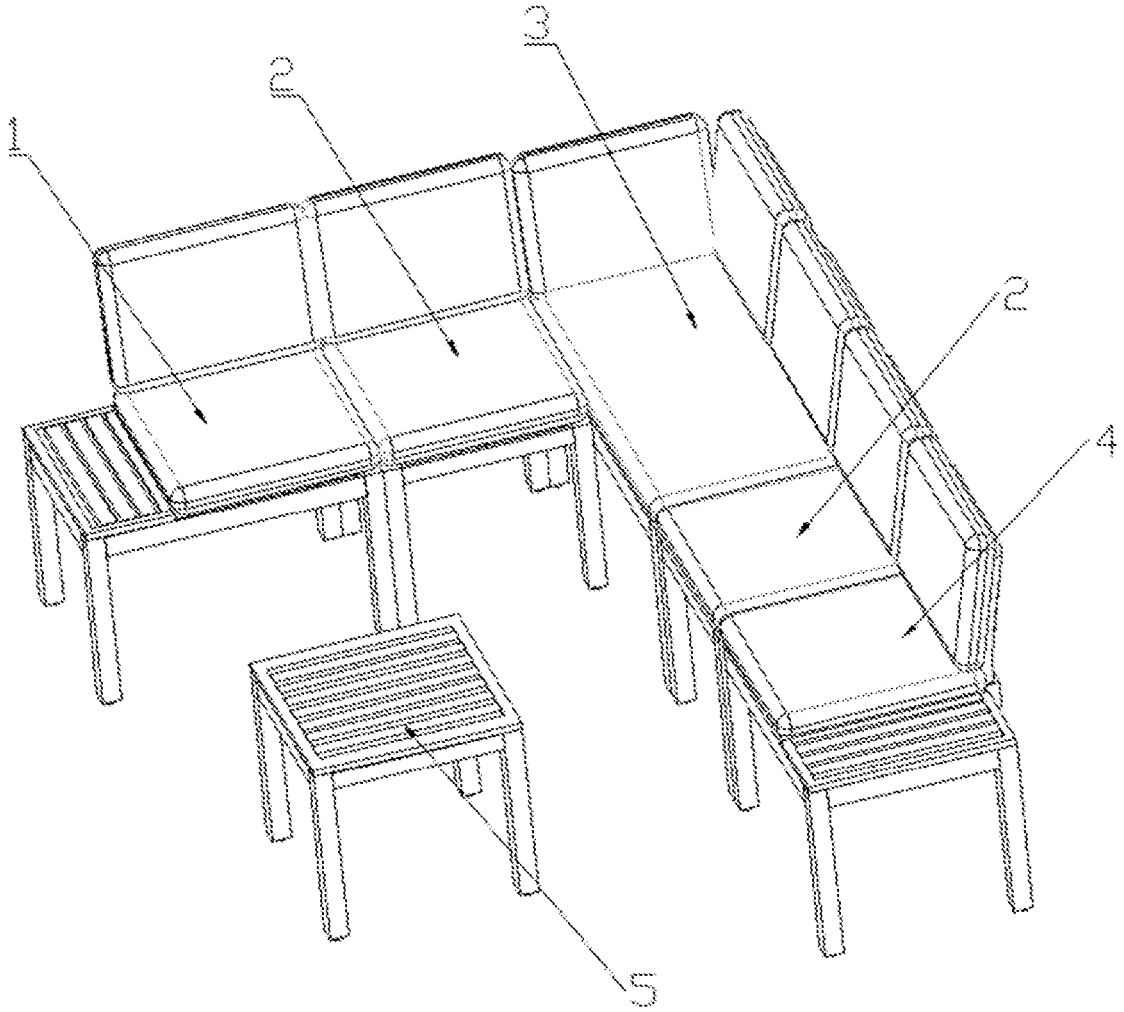
FIG. 1 is a schematic view of an assembled overall structure according to multiple embodiments of the invention.

With reference to an appearance 1 of Embodiment 1 of FIG. 1, a frame 1-1 of Embodiment 1 of FIG. 2, FIG. 4, FIG. 6, FIG. 7, FIG. 9. FIG. 11, FIG. 14, FIG. 15, FIG. 16 and FIG. 17, four components E are connected to a component B by means of a component L and a component M via a through hole 9 and a threaded hole 6. A rubber pad 10 is located at the bottom of component E. An insert block 8 of a component D is inserted on a rim of the component B. A pouch 11 of a component I is sheathed on the component D. A component G is provided on a table top of the component B. A small wooden table top 7 is provided on the table top of the component B so as to constitute an independent sofa.

Embodiment 2

With reference to an appearance 2 of Embodiment 2 of FIG. 1, a frame 2-1 of Embodiment 2 of FIG. 2, FIG. 3, FIG. 6, FIG. 7, FIG. 9, FIG. 11, FIG. 14, FIG. 15, FIG. 17 and FIG. 18, four components E are connected to a component A by means of a component L and a component M via a through hole 9 and a threaded hole 6. A rubber pad 10 is located at the bottom of component E. An insert block 8 of a component D is inserted on a rim of component A. A pouch 11 of a component I is sheathed on the component D. A component G is provided on a table top of the component A so as to constitute an independent sofa.

Embodiment 3

Figure 15:
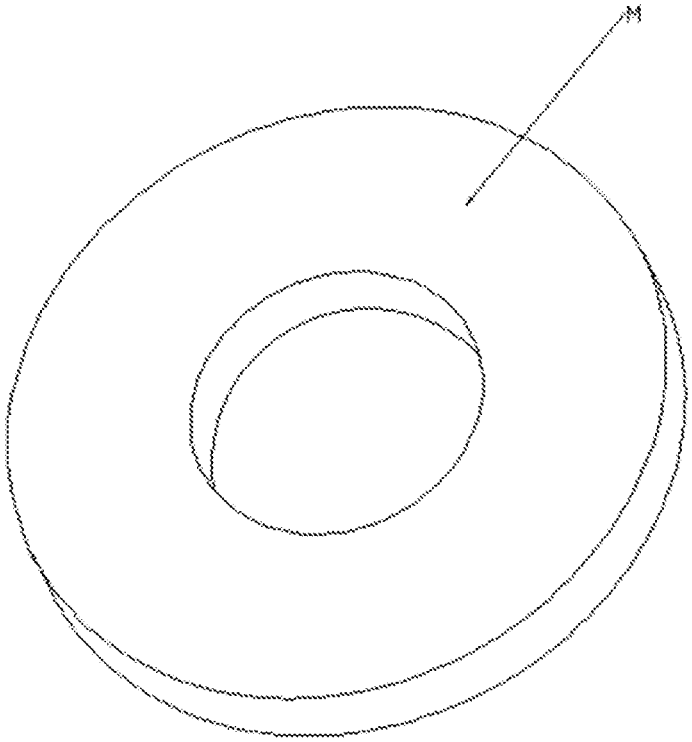
FIG. 15 is a structurally schematic view of a component M according to the invention.
Figure 16:
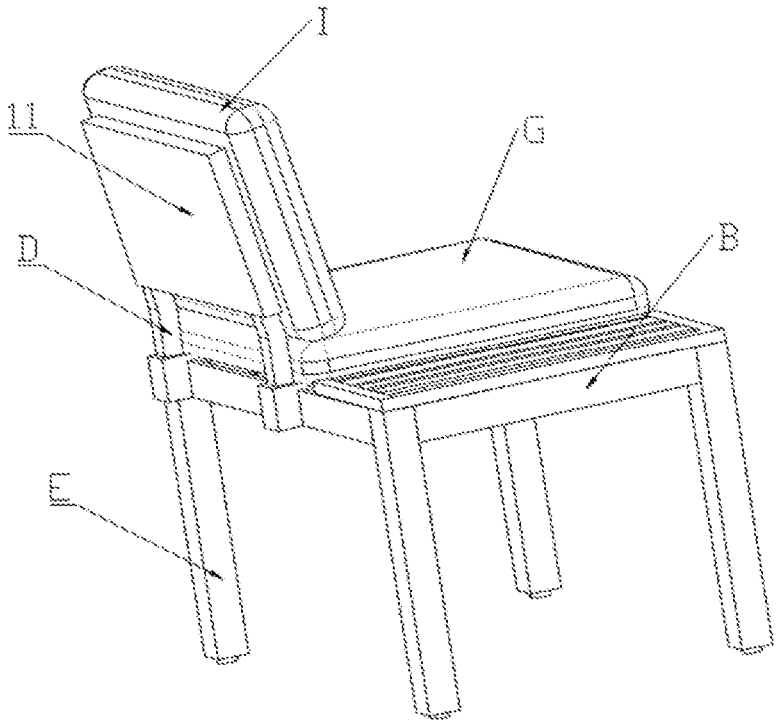
FIG. 16 is a structurally schematic view according to Embodiment 1 of the invention.
Figure 17:
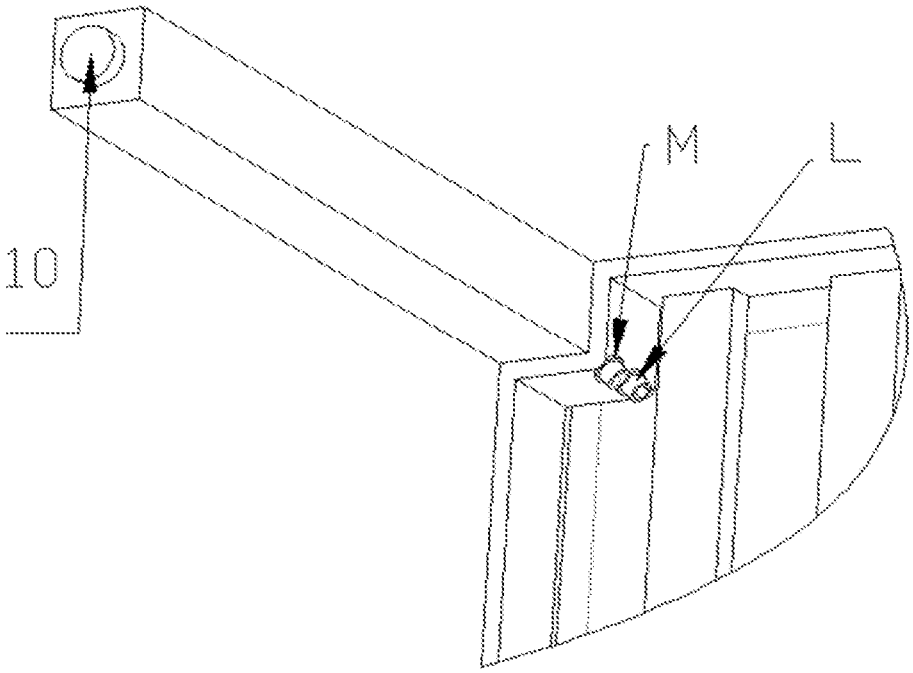
FIG. 17 is a schematic view of a bolted connection structure according to an embodiment of the invention.
Figure 18:
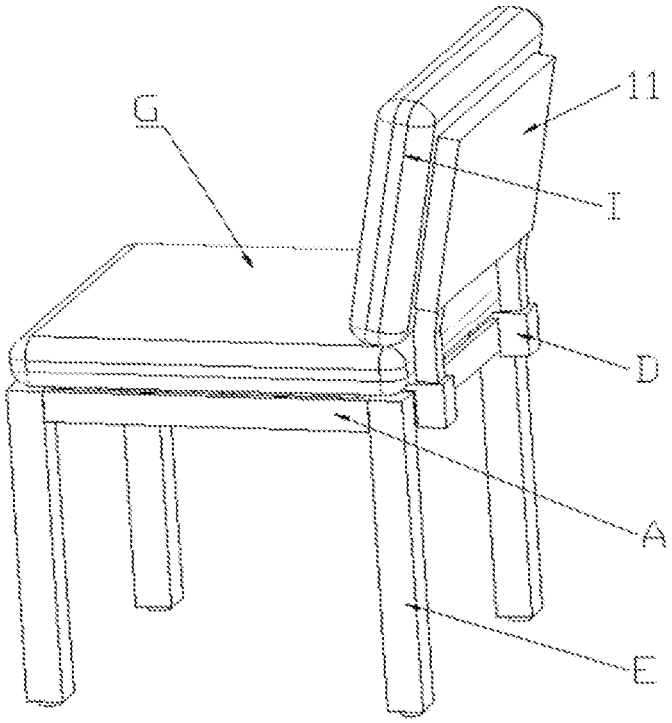
FIG. 18 is a structurally schematic view according to Embodiment 2 of the invention.
Figure 19:
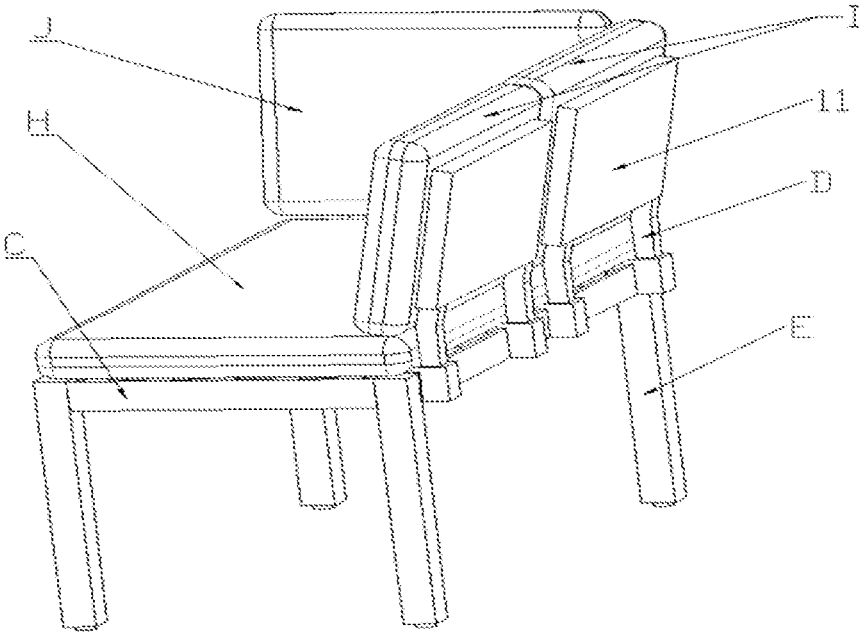
FIG. 19 is a structurally schematic view according to Embodiment 3 of the invention.
Figure 20:
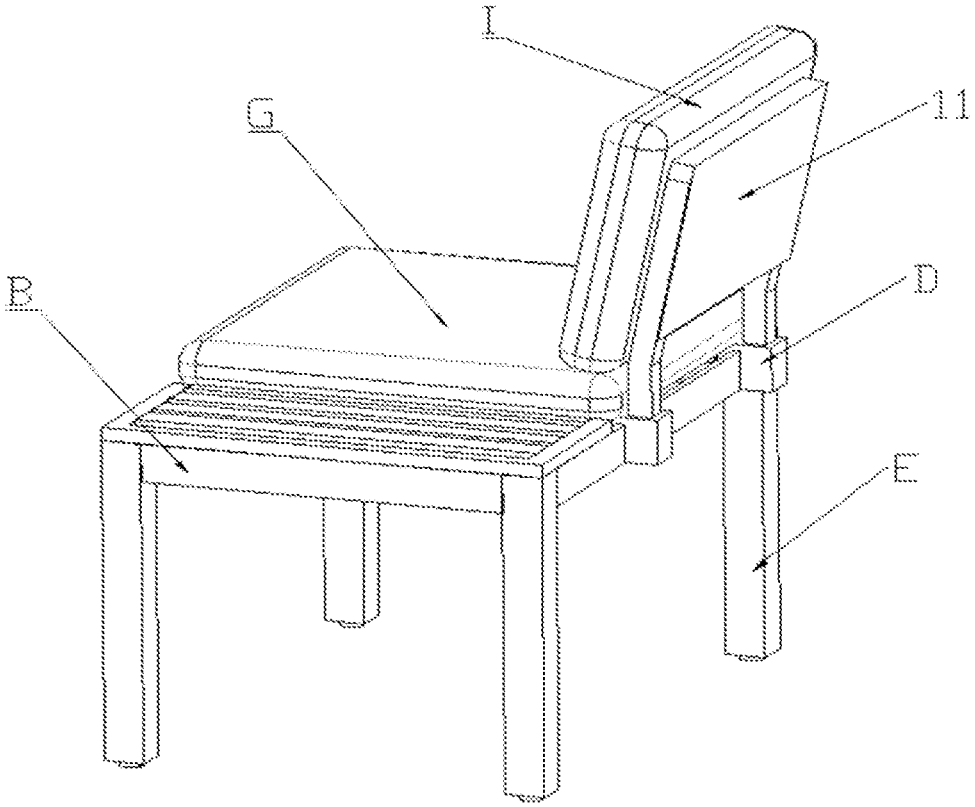
FIG. 20 is a structurally schematic view according to Embodiment 4 of the invention.
Figure 21:
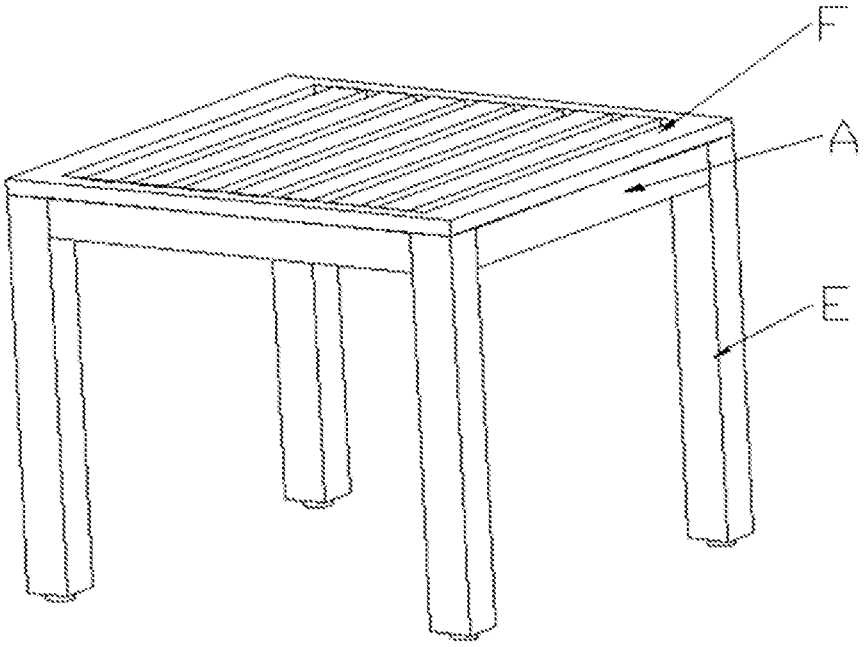
FIG. 21 is a structurally schematic view according to Embodiment 5 of the invention.

With reference to an appearance 3 of Embodiment 3 of FIG. 1, a frame 3-1 of Embodiment 3 of FIG. 2, FIG. 5, FIG. 6, FIG. 7, FIG. 10, FIG. 11, FIG. 12, FIG. 14. FIG. 15, FIG. 17 and FIG. 19, four components E are connected to a component C by means of a component L and a component M via a through hole 9 and a threaded hole 6. Insert blocks 8 of two components D are inserted on a long rim of the component C. The insert block 8 of one component D is inserted on a short rim of the component C. A pouch 11 of two components I is sheathed on the component D on the long rim of the component C. The pocket 11 of one component J is sheathed on the component D on the short frame of the component C. A component H is provided on a table top of the component C so as to constitute an independent sofa.

Embodiment 4

With reference to an appearance 4 of Embodiment 4 of FIG. 1, a frame 4-1 of Embodiment 4 of FIG. 2, FIG. 4, FIG. 6, FIG. 7, FIG. 9, FIG. 11, FIG. 14, FIG. 15, FIG. 17 and FIG. 20, four components E are connected to a component B by means of a component L and a component M via a through hole 9 and a threaded hole 6. A rubber pad 10 is located at the bottom of component E. An insert block 8 of a component D is inserted on a rim of the component B. A pouch 11 of a component I is sheathed on the component D. A component G is provided on a table top of the component B. A small wooden table top 7 is provided on the table top of the component B so as to constitute an independent sofa.

Embodiment 5

Figure 2:
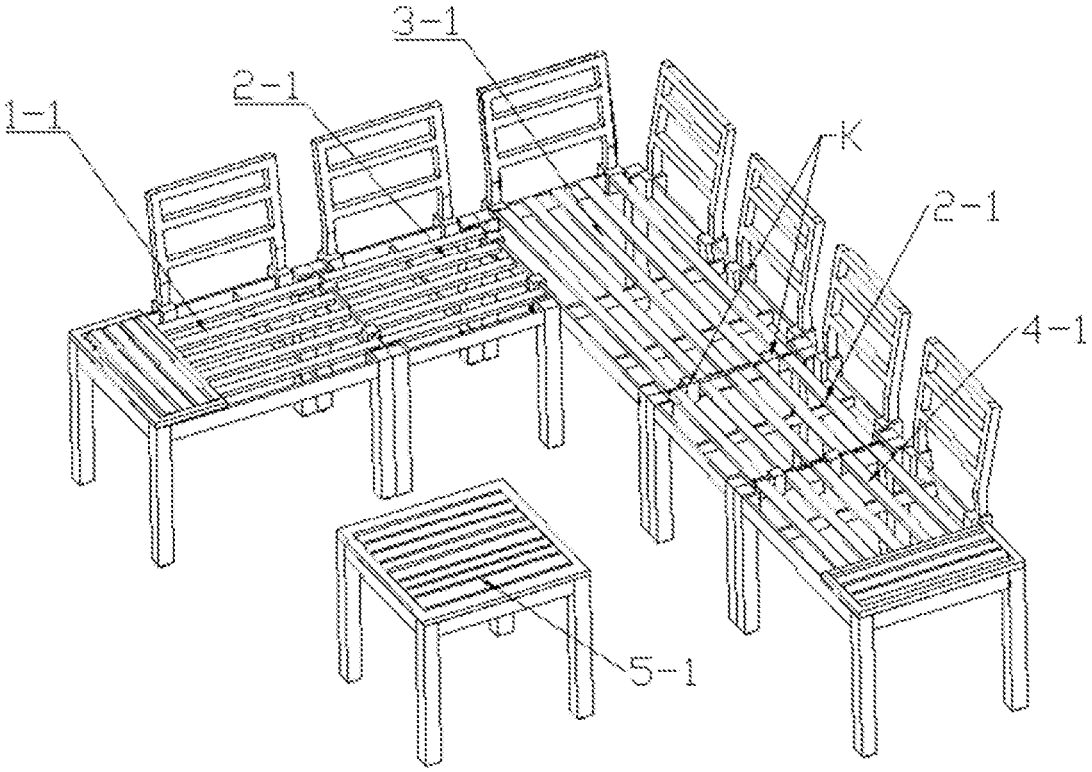
FIG. 2 is an overall schematic view of a frame assembly structure according to multiple embodiments of the invention.
Figure 3:
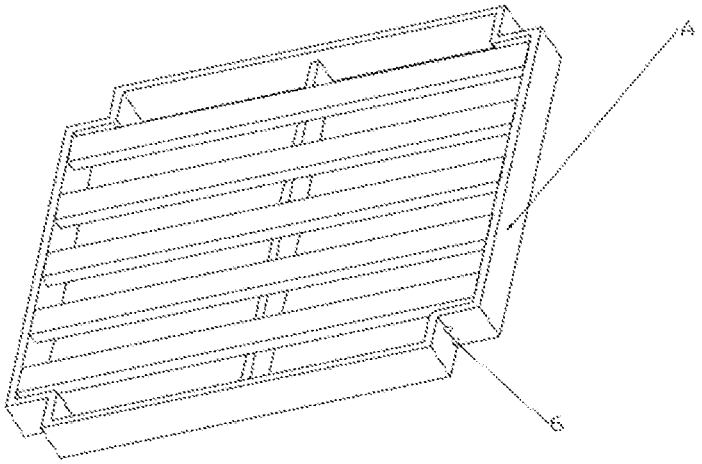
FIG. 3 is a structurally schematic view of a component A according to the invention.
Figure 4:
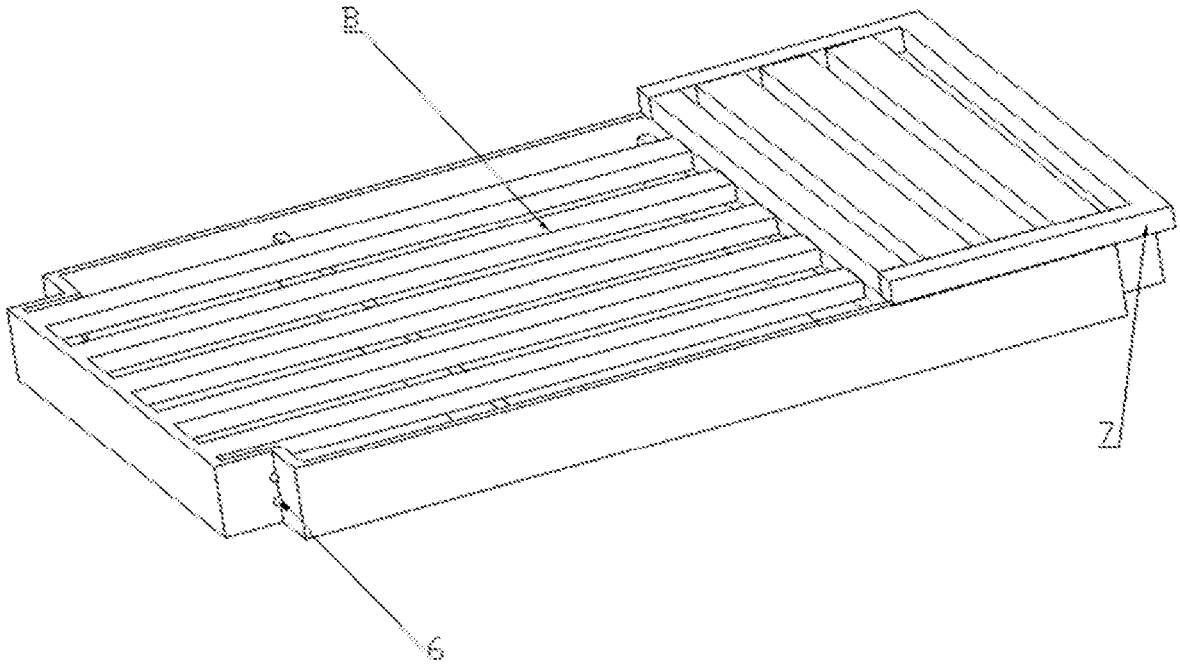
FIG. 4 is a structurally schematic view of a component B according to the invention.
Figure 5:
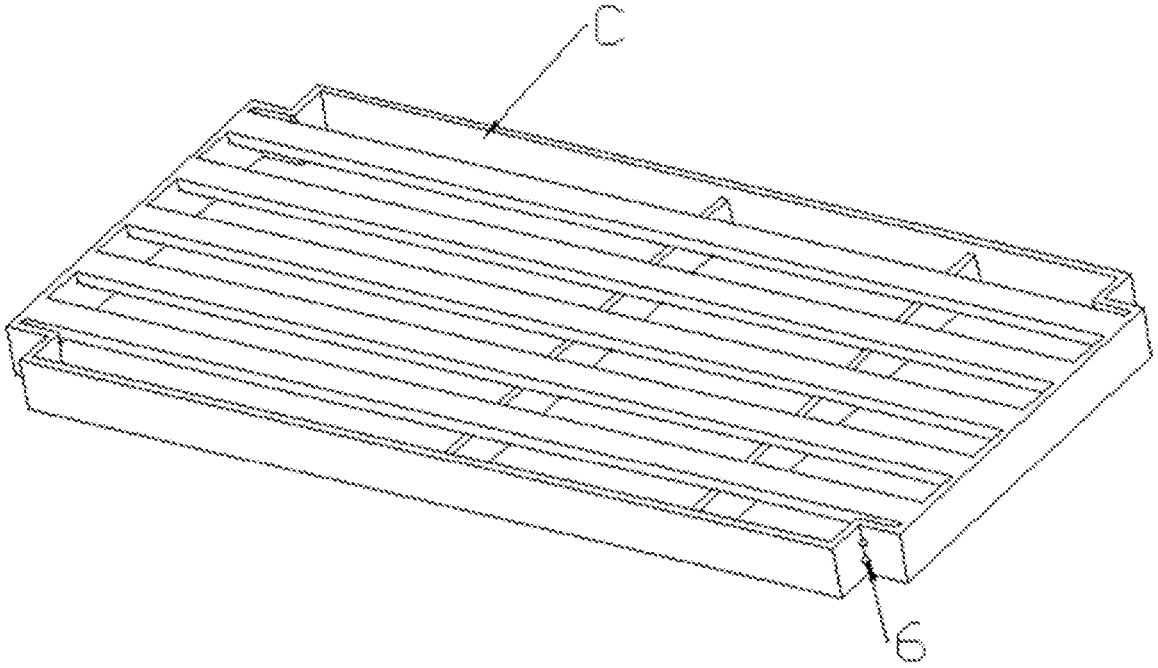
FIG. 5 is a structurally schematic view of a component C according to the invention.
Figure 6:
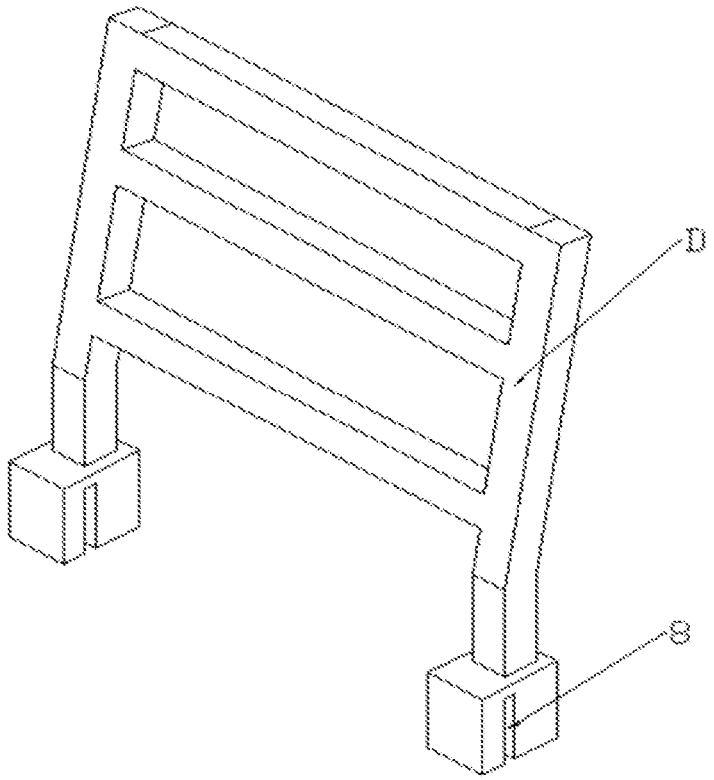
FIG. 6 is a structurally schematic view of a component D according to the invention.
Figure 7:
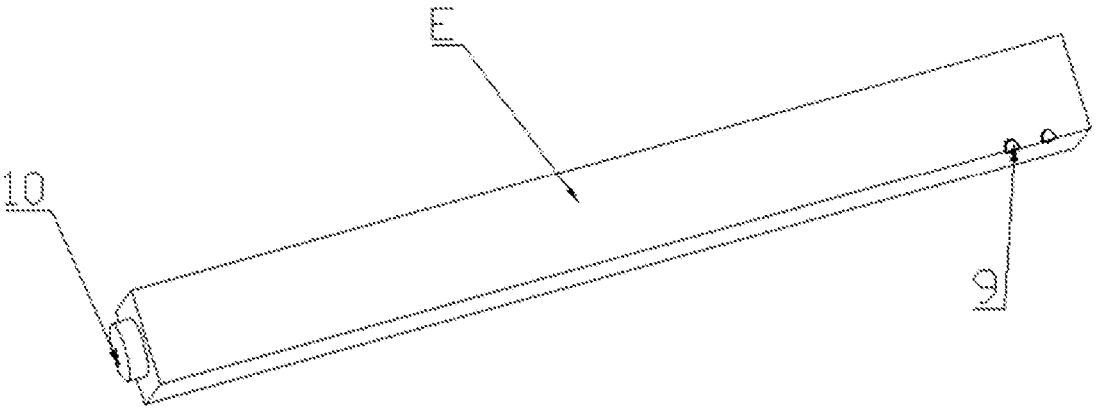
FIG. 7 is a structurally schematic view of a component E according to the invention.
Figure 8:
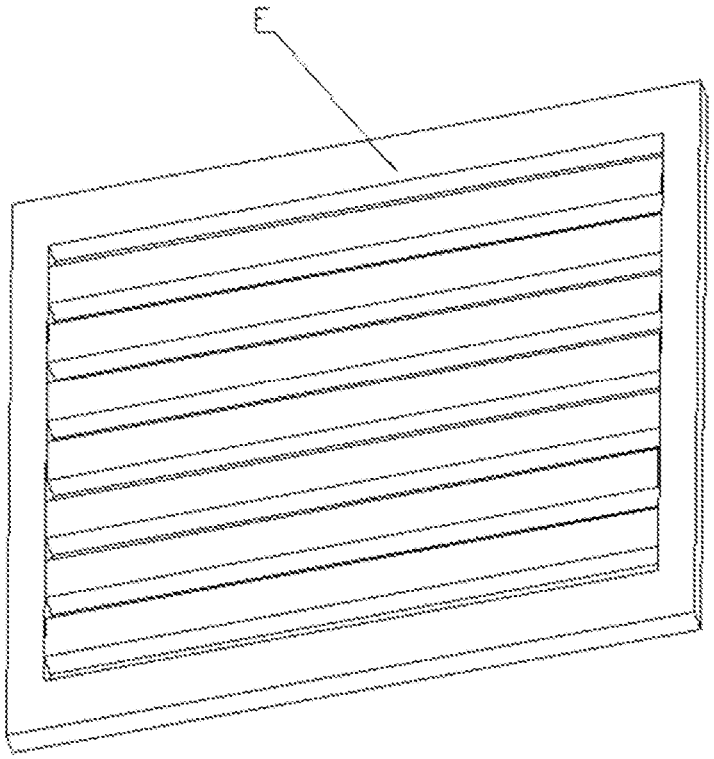
FIG. 8 is a structurally schematic view of a component F according to the invention.
Figure 9:
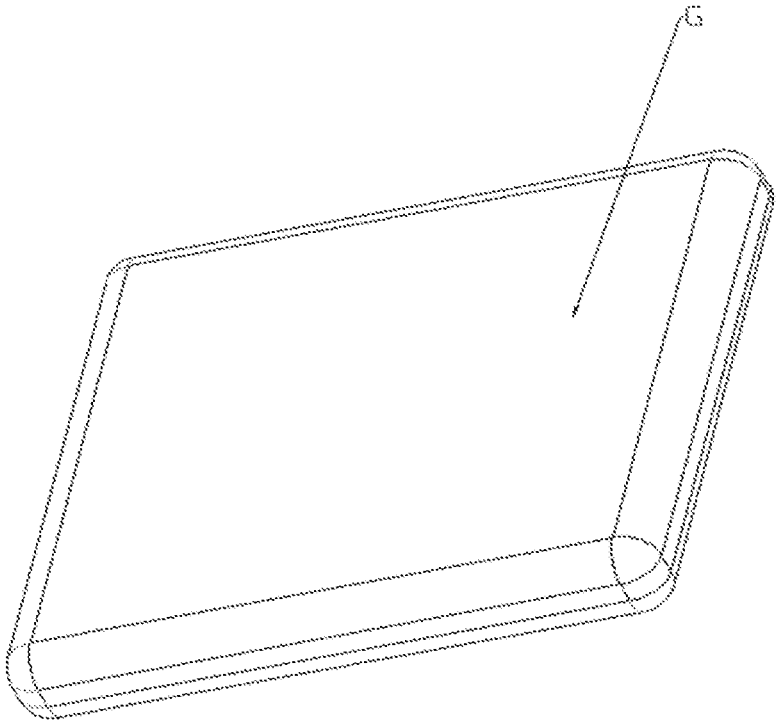
FIG. 9 is a structurally schematic view of a component G according to the invention.
Figure 10:
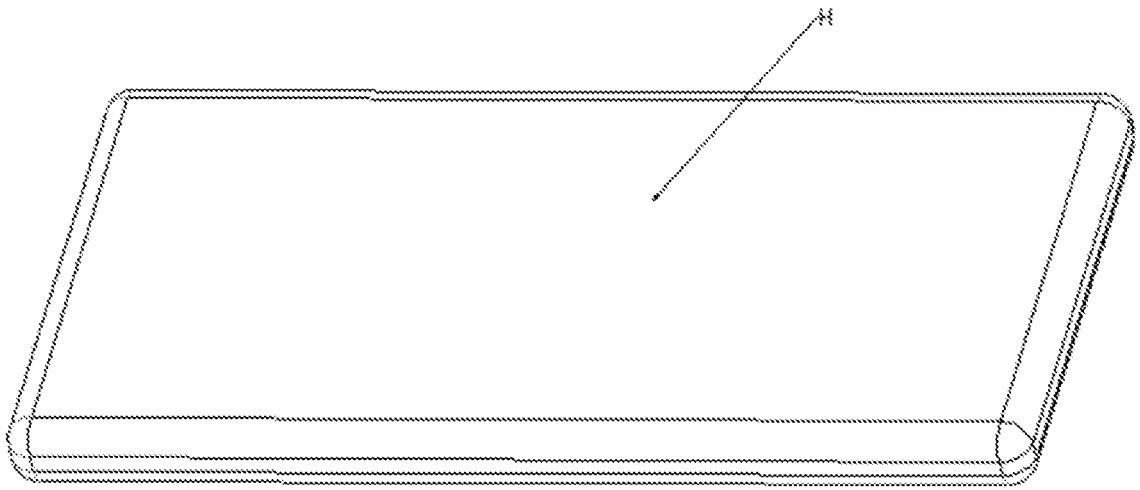
FIG. 10 is a structurally schematic view of a component H according to the invention.
Figure 11:
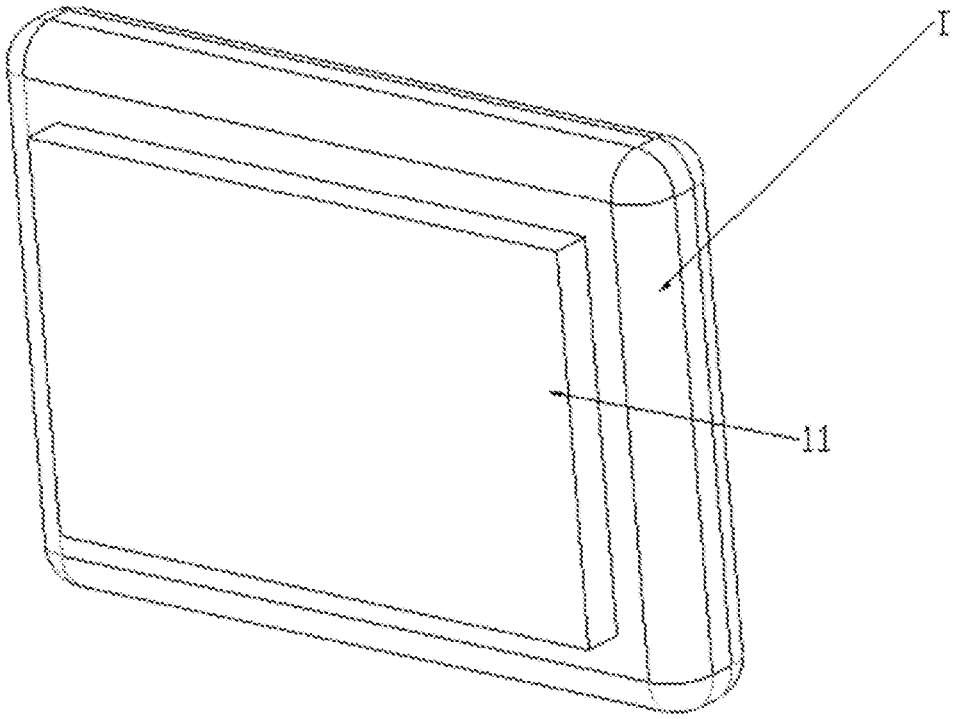
FIG. 11 is a structurally schematic view of a component I according to the invention.
Figure 12:
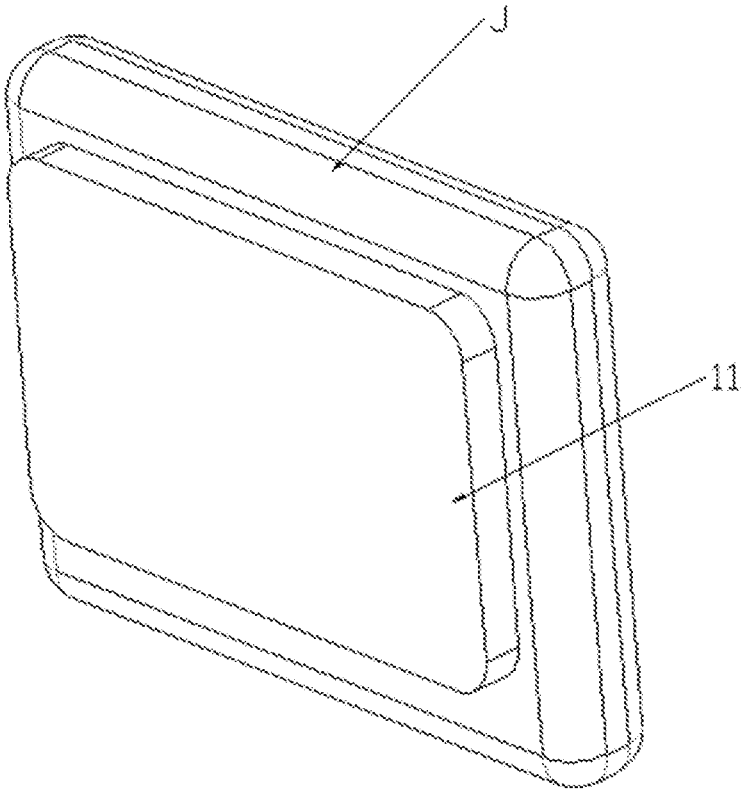
FIG. 12 is a structurally schematic view of a component J according to the invention.
Figure 13:
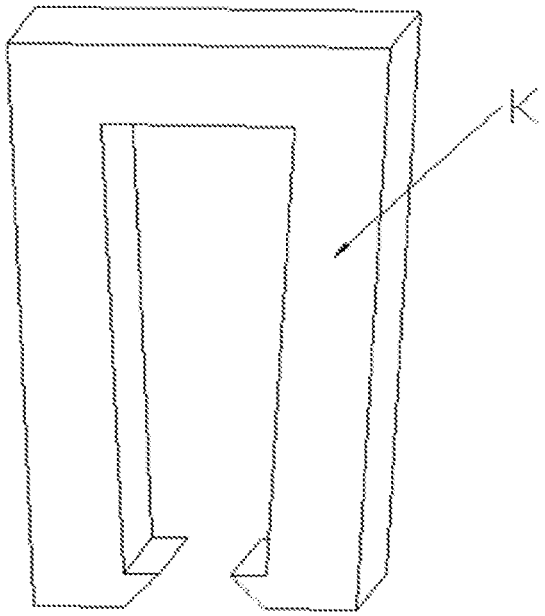
FIG. 13 is a structurally schematic view of a component K according to the invention.
Figure 14:
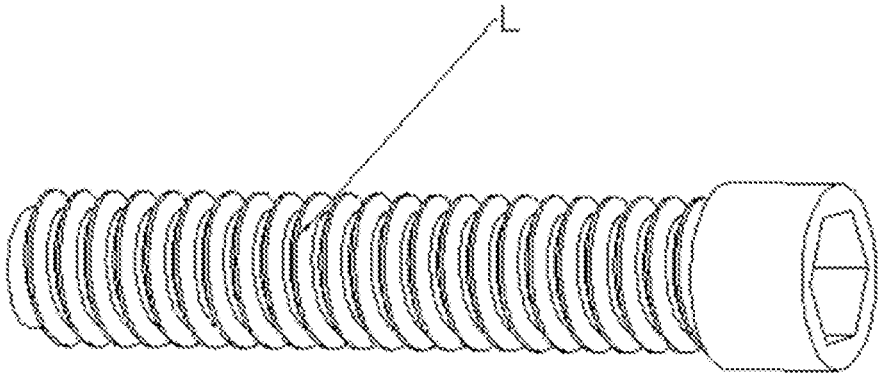
FIG. 14 is a structurally schematic view of a component L according to the invention.

With reference to an appearance 5 of Embodiment 5 of FIG. 1, a frame 5-1 of Embodiment 5 of FIG. 2. FIG. 3, FIG.

7, FIG. 8, FIG. 14, FIG. 15, FIG. 17 and FIG. 21, four components E are connected with a component A by means of a component L and a component M via a through hole 9 and a threaded hole 6. A component F is provided on a table top of the component A so as to constitute a tea table.

Embodiment 6

With reference to FIGS. 1 and 2, the embodiments 1-4 are arranged in the order of Embodiment 1, Embodiment 2. Embodiment 3, Embodiment 2, and Embodiment 4. For adjacent embodiments, the rims of the frames of adjacent embodiments are clamped together by two components K. A tea table of Embodiment 5 is placed in front of a sofa combination to constitute a complete set of lounge furniture.

What is claimed is:

1. A detachable assembled lounge furniture, comprising a plurality of components: a component A, a component B, a component C, a component D, a component E, a component F, a component G, a component H, a component I, a component J, a component K, a component L, and a component M, which are formed into various combinations to constitute various lounge furniture;

the detailed structure of each component is as follows:

Component A, wherein four L-shaped connecting plates with equal side lengths are made of metal strips; an upper threaded hole and a lower threaded hole are provided on a corner folding line of the L-shaped connecting plate; rectangular metal pipes with equal lengths are welded outside two sides of the L-shaped connecting plate respectively; four L-shaped connecting plates and four rectangular metal pipes constitute a square frame with an unfilled corner; the metal strips are welded on the frame at intervals in the middle of the frame to form a table top; the metal strips are provided below the table top as reinforcing ribs;

Component B, wherein four L-shaped connecting plates with equal side lengths are made of metal plate strips; an upper threaded hole and a lower threaded hole are provided on a corner folding line of the L-shaped connecting plate; rectangular metal pipes with unequal lengths are welded outside two sides of the L-shaped connecting plate; four L-shaped connecting plates and four rectangular metal pipes with unequal lengths constitute a rectangular frame with an unfilled corner; the metal plate strips are welded on the frame at intervals in the middle of the frame to constitute a table top; the metal plate strips are provided below the table top as reinforcing ribs; a wooden table top is provided on one side of the table top of the rectangular frame;

Component C, wherein four L-shaped connecting plates with equal side lengths are made of metal strips; an upper threaded hole and a lower threaded hole are provided on a corner folding line of the L-shaped connecting plate; rectangular metal pipes with unequal lengths are welded outside two sides of the L-shaped connecting plate; four L-shaped connecting plates and four rectangular metal pipes with unequal lengths form a rectangular frame with an unfilled corner; the metal plate strips are welded on the frame at intervals in the middle of the frame to form a table top; metal plate strips are provided below the table top as reinforcing ribs;

Component D, a moon-shaped back rest made of a metal tube, wherein an insert block with an n-shaped groove is provided below two vertical rims and is inserted on the rims of the components A, B and C;

Component E, a support leg made of a metal square tube, wherein an upper through hole and a lower through hole are provided on a flanging line of the square tube at the upper end of the support leg; the top surface of the support leg is plugged with a steel plate; a rubber pad is provided below the support leg;

Component F, a square table top with spaced wooden slats;

Component G, a square sofa cushion;

Component H, a rectangular sofa cushion, the length of which is twice that of the square sofa cushion, and the width of which is the same as that of the square sofa cushion;

Component I, a sofa back, wherein a pouch is provided on the back and is sheathed on the sofa back rest of the component D;

Component J, a short back of the sofa, wherein a pouch is provided on the back and is sheathed on the sofa back rest of the component D;

Component K, an n-shaped clip made of plastic, wherein both sides are in an inverted cone shape; a hook is provided at a lower part of the n-shaped clip;

Component L, a bolt; and

Component M, a spacer.

2. The detachable assembled lounge furniture according to claim 1, wherein the rectangular frame of the component C has a length twice that of the component A.

3. The detachable assembled lounge furniture according to claim 1, wherein the components A, B, C and F have the same width.

4. The detachable assembled lounge furniture according to claim 1, wherein after the component E is respectively connected with the components A, B and C by means of the components L and M, the top surface of the component E is at the same height as the table tops of the frames of the components A, B and C.

* * * * *